United States Patent [19]

Hösel

[11] Patent Number: 4,503,430

[45] Date of Patent: Mar. 5, 1985

[54] APPARATUS FOR TRANSMITTING SIGNALS IN A POWER DRIVEN TEXTILE MACHINE

[75] Inventor: Fritz Hösel, Monchen-Gladbach, Fed. Rep. of Germany

[73] Assignee: Trützschler GmbH & Co. KG, Monchen-Gladbach, Fed. Rep. of Germany

[21] Appl. No.: 396,644

[22] Filed: Jul. 9, 1982

[30] Foreign Application Priority Data

Jul. 9, 1981 [DE] Fed. Rep. of Germany ..... 3127088

[51] Int. Cl.[3] ..... H04Q 9/00

[52] U.S. Cl. ..... 340/825.52; 340/825.57; 19/98

[58] Field of Search ..... 340/825.52, 825.07, 340/825.57, 825.62, 696; 19/98

[56] References Cited

U.S. PATENT DOCUMENTS

| | | | |
|---|---|---|---|
| 3,648,244 | 3/1972 | McGee . | |
| 4,241,331 | 12/1980 | Taeuber et al. | 340/696 |
| 4,355,309 | 10/1982 | Hughey et al. | 340/696 |
| 4,356,485 | 10/1982 | Boschulte et al. | 340/825.62 |
| 4,426,697 | 1/1984 | Petersen et al. | 340/825.52 |

FOREIGN PATENT DOCUMENTS 2054226 2/1981 United Kingdom .

OTHER PUBLICATIONS

Fritz Hösel et al., "Opening by Automatic, Micro--Processor Controlled Bale Work-Off", Chemiefasern-/Textilindustrie, vol. 31, No. 83, 1981, pp. E 32-E 33.

*Primary Examiner*—Donald J. Yusko

*Attorney, Agent, or Firm*—Spencer & Frank

[57] ABSTRACT

Apparatus for transmitting signals between a fixed station to a mobile station in a power driven textile machine, e.g. a bale opener for textile fiber bales wherein the bale opener including a movable delivery member. The fixed station includes a transmitter and a receiver and the mobile station includes a transmitter and a receiver with each transmitter being disposed opposite a receiver of the other station. The transmitter includes a clock pulse generator which feeds a counter at whose output a plurality of bits are formed for addresses, with these bits being fed to a multiplexer. In dependence on the address bits, a certain data input is selected at the multiplexer so that an electrical connection is established between the selected data input and a release or gate unit which releases the address at the output of the counter to a transmitting encoder if a signal is present at the selected data input. The receiver includes a clock pulse generator which feeds a counter at whose outputs a plurality of bits are formed for addresses. These address bits are fed both to a receiving decoder and to a demultiplexer and an electrical connection is established between the receiving decoder and a release unit if the received transmitted data coincides with the address formed by the counter of the receiver so that an actuating signal for a certain output is formed in the demultiplexer.

17 Claims, 6 Drawing Figures

APPARATUS FOR TRANSMITTING SIGNALS IN A POWER DRIVEN TEXTILE MACHINE

BACKGROUND OF THE INVENTION

The present invention relates to an apparatus for transmitting signals from a fixed station to a mobile station in a power driven textile machine, e.g. a bale opener for textile fiber bales, with the bale opener being equipped with a movable delivery member.

In a known power driven textile machine of the type mentioned above, a plurality of signals must be transmitted from a fixed station to a mobile station and vice versa, requiring complicated cables or conductors, which interconnect the two stations and which must be of substantial length so that they can move with the mobile station to all positions. Such an interconnecting cable includes lines or conductors for the supply of energy to the drive of the movable member including the delivery member. Moreover, lines are provided for supplying the signal voltage to the movable member. Finally, there are lines for the transmission of signals.

Such an apparatus is complicated and the difficulties connected with installation of the cables are annoying.

SUMMARY OF THE INVENTION

It is therefore an object of the present invention to provide a device of the above-mentioned type which is structurally simpler and installed more easily.

The above object is achieved by an apparatus for transmitting signals between a fixed station and a mobile station in a power driven textile machine, which comprises in combination a transmitter and a receiver disposed at the fixed station, and a transmitter and a receiver disposed at the mobile station, with the transmitter at the fixed station being associated with the receiver at the mobile station and with the receiver at the fixed station being associated with the transmitter at the mobile station. Each of the transmitters includes: a clock pulse generator; counter means for counting the clock pulses from the pulse generator and for providing a plurality of bits, which form addresses, at its output; multiplexer means, having a plurality of data inputs and responsive to the bits provided by the counter means, for selecting a certain one of its data inputs in dependence on the particular address so as to establish an electrical connection between the selected data input and a release input of a gate circuit whose data input is connected to the output of the counting means; and a transmitting encoder means, having it input connected to the output of the gate circuit, for providing coded data for transmission to the associated receiver, whereby the electrical connection causes the gate circuit to release the address being provided by the counter means to the transmitting encoder means if a signal is present at the selected data input; and each receiver includes: a further clock pulse generator; further counter means for counting the clock pulses from the further clock pulse generator and for providing a plurality of bits, which form addresses, at its output; receiving decoder means for comparing received transmitted data, corresponding to the address of a selected input of the multiplexer means of the associated transmitter, with the address output data provided by the further counter means and for providing an output signal when the data coincide; signal release means, connected to the output of the receiving decoder means, for providing an output signal only upon receipt of the output signal from the receiving decoder means; and a demultiplexer means, responsive to the address data from the further counter means and to the output signal from the signal release means, for providing an output signal on the one of its data outputs corresponding to the address indicated by the concurrent address data from the further counter means.

The multiplexer reduces the number of lines or conductors required in that from a multitude of signal input lines, only one is selected at a time whose signals are processed or transmitted, respectively. The principle of transmission is based on the fact that a multiplexer receives a series of parallel signals. Each one of these signals is assigned a certain identifying binary code. By means of an interrogation device, the multiplexer is continuously interrogated to determine at which of its inputs signals are present. For each signal present, the transmitter encoder forms the corresponding transmitting information which essentially includes the respective binary code. These signals are fed serially to the transmitting amplifier so as to actuate a suitable transmitting device, for example, an IR (infrared) transmitting diode. The multiplexer is interrogated cyclically. In the receiver, the received information is fed to a receiving decoder. An interrogation arrangement here determines which binary code or codes have been received. In dependence on the received binary code, a demultiplexer then actuates each output, e.g. a monoflop, associated with a respective received code.

With this arrangement, the output of the monoflop is then able to drive, via a power amplifier, relays, displays or the like. Also, the state of the output signal of the multiplexer or monoflop can be monitored by means of a display device. The signals can be transmitted between the fixed and mobile stations through lines, e.g. cables, or wirelessly, e.g. in the infrared technique. In any case, the system operates in full duplex in that the fixed station has a transmitter and a receiver which communicate with the receiver and the transmitter respectively of the mobile station. Thus, the interconnecting cable can be reduced, for example, from three cables having 61 conductors to 1 cable having 10 conductors. In order to increase the interrogation speed of the transmitting device, the interrogation cycle is interrupted as soon as it has been determined that a respective input signal is not present at the transmitter so that no signals are transmitted and the next input signal is interrogated at once.

Preferably, according to a further feature of the invention, if in a wireless communication arrangement wherein the receiver and transmitter of the fixed station are disposed opposite the transmitter and receiver respectively of the mobile station of the textile machine and if the arm holding the delivery member of the mobile station of the textile machine, e.g. the bale opener, is rotated into a different operating position, another pair of transmitters and receivers faces the receiver or transmitter, respectively, of the fixed station. By pivoting the arm of the textile machine through 180°, it is possible to change the system at any time to mix a different group of bales. While the bales on one side are being processed, a further group of bales on the other side can already be prepared.

DETAILED DESCRIPTION OF THE PREFERRED EMBODIMENTS

Figure 1:
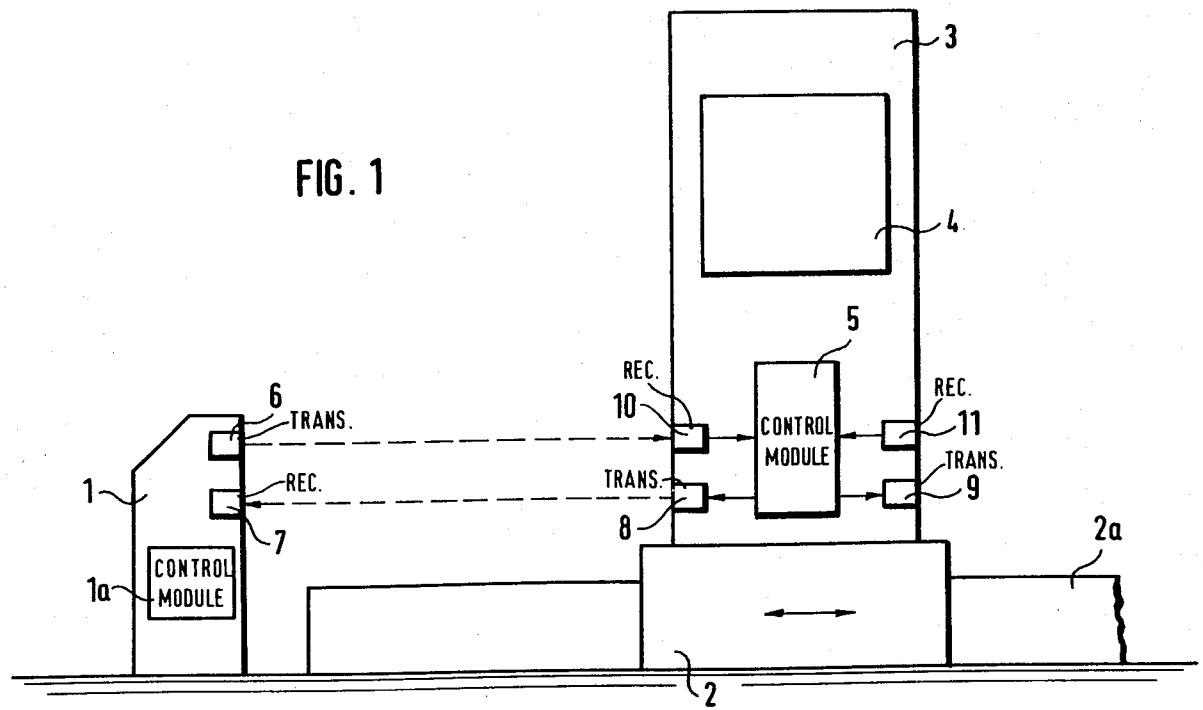
FIG. 1 is a schematic side view of a power driven textile machine, and in particular a movable bale opener, including a signal transmitting and receiving apparatus according to the invention.
Figure 2:
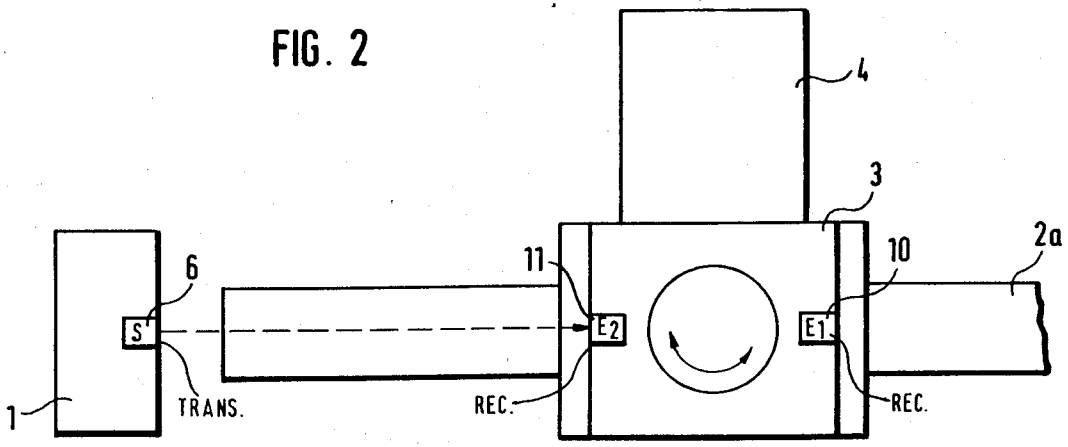
FIG. 2 is a top view of the apparatus of FIG. 1 with the delivery member of the bale opener rotated through 180°.

Turning now to FIGS. 1 and 2, there is schematically shown a power driven textile machine, and in particular, a bale opener, having a fixed and a mobile station, each of which receives and transmits information. According to these figures, the fixed station 1 is, for example, an operating desk or console including known operating elements (not shown) such as switches and the like and a control module 1*a* which provides output signals in response to the position of the operating elements. The mobile station of the textile machine includes a horizontally movable carriage 2 equipped with a vertically extending tower 3 having a laterally extending but vertically movable arm 4. The carriage 2 has an associated fixed suction channel 2*a* for the fiber material removed from the bales (not shown). The arm 4 includes delivery members which remove fibers from the top of a fiber bale (not shown).

A power driven bale opener with movable arm, as shown schematically in FIGS. 1 and 2, is known, for example, from the article by F. Leifeld, "Staubbekämpfung in der Spinnereivorbereitung—Stand der Entwicklung im Maschinenbau" [Dust Control in Preparatory Operations for Spinning—Present Stage of Development in Machine Construction] MELLIAND TEXTILBERICHTE [Melliand Textile Reports], Vol. 61 (1980), pages 475–479, which describes the Trätzschler-BLENDOMAT.

In the fixed station 1, there are disposed one transmitter 6 and one receiver 7 which are connected to the control module 1*a* and, in the tower 3 of the mobile station, there are disposed, for example, two transmitters 8, 9 and two receivers 10, 11. Transmitter 6 and receiver 10 are positioned so that they face one another and transmitter 8 and receiver 7 are disposed so that they face one another. Transmitters 8 and 9 as well as receivers 10 and 11 are in electrical connection with a control module 5 in the tower 3.

As shown in FIG. 2, the arm 4 including the delivery members has been rotated through 180° relative to the position shown in FIG. 1 and thus into a different operating position where different bales may be acted upon while new bales are being prepared at the initial position. In this new and different position, transmitter 6 faces receiver 11. Although not shown, in this position transmitter 9 now faces receiver 7. The beam path between transmitters 6, 8, 9 and receivers 7, 10, 11 is shown in FIGS. 1 and 2 by dashed arrows.

Figure 3:
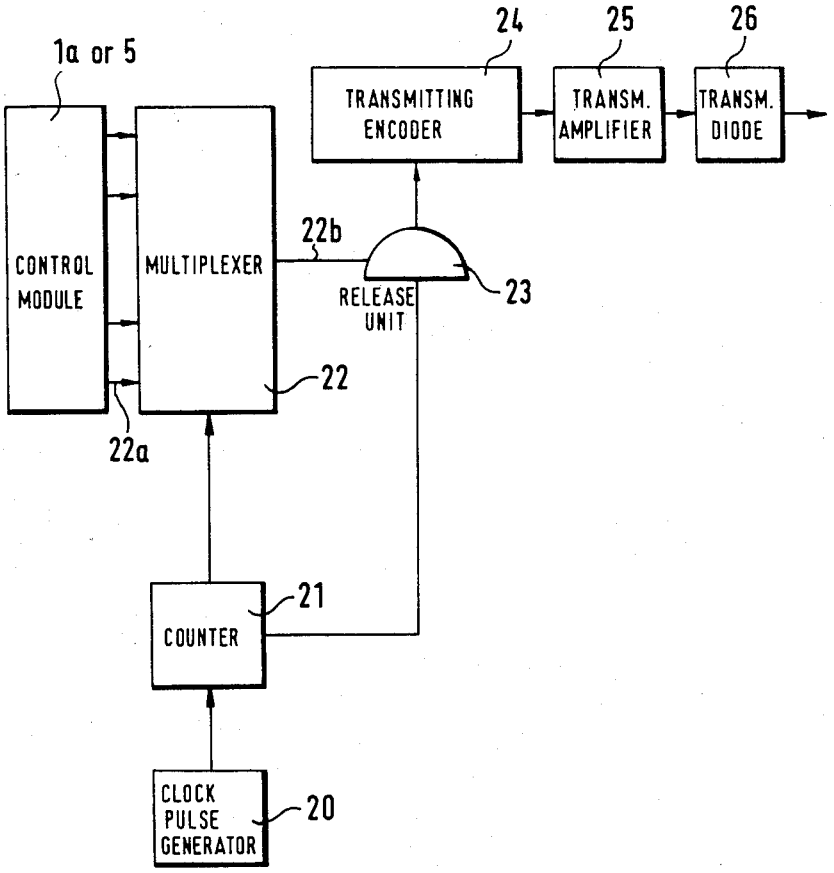
FIG. 3 is a basic block circuit diagram of the transmitter of the apparatus according to the invention.

FIG. 3 shows a block circuit diagram of transmitter 6, 8 or 9, in which a clock pulse generator 20 has its output connected to a counter 21 at whose parallel outputs a plurality of bits, corresponding to the count, are formed for providing addresses. The output bits from the counter 21 are fed to a multiplexer 22 which receives control signals generated by control module 1*a* or 5 depending on the location of the particular transmitter. In dependence on the particular address represented by the output signal of counter 21, a certain one of the data inputs 22*a* is selected for interrogation by the multiplexer 22, thus establishing an electrical connection, via the output lead 22*b* of multiplexer 22, between the selected data input 22*a* and a release unit 23, e.g. a blockable gate. Consequently, if a signal is present at the selected data input 22*a*, this signal, via the established electrical connection, causes unit 23 to open and release the corresponding address from counter 21 for travel to a transmitter encoder 24 for conversion to a code form suitable for transmission. The transmitter encoder 24 has its output connected in series with a transmitting amplifier 25 and a transmitting diode 26, e.g. an infrared transmitting diode, which constitutes the actual transmitter in the preferred embodiment of the invention.

Figure 4:
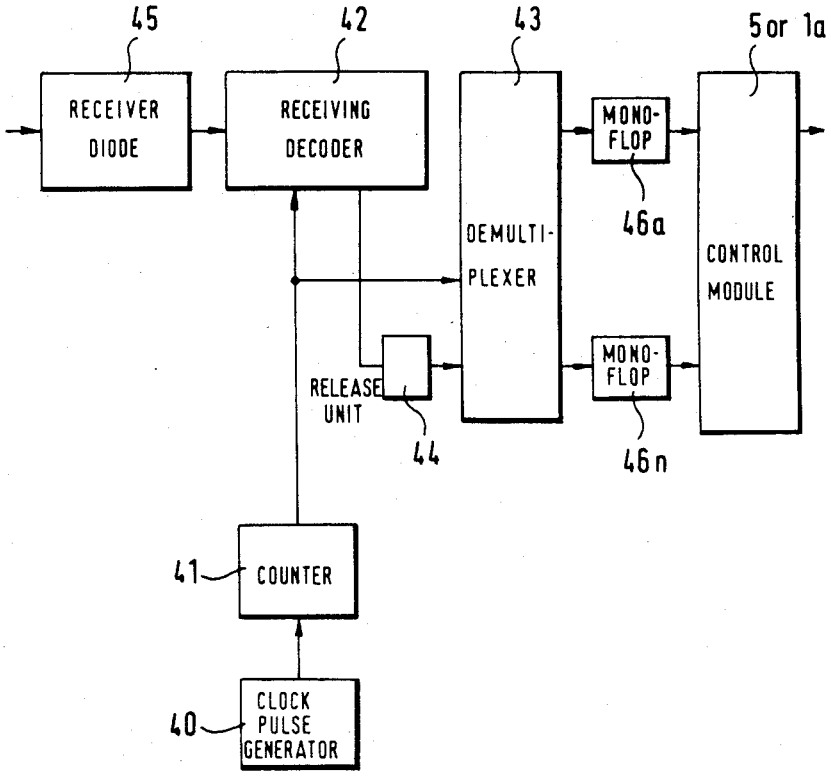
FIG. 4 is a basic block circuit diagram of the receiver of the apparatus according to the invention.

FIG. 4 is a block circuit diagram of the receiver 7, 10 or 11 in which a clock pulse generator 40, which produces clock pulses of a greater frequency than those produced by generator 20, has its output in connection with a counter 41 at whose outputs a plurality of parallel bits which constitute addresses are formed. These bits or output signals from the counter 41 are fed, both to a receiving decoder 42 and to a demultiplexer 43. The receiving decoder 42 has an output connected to a release unit 44 and a further input connected to the output of a receiving diode 45 for the transmitted data. The receiving decoder 42 compares the received transmitted data with the address formed by the counter 41 and provides an input signal to the release unit 44 if the two signals being compared coincide. The output of the release unit 44 is in communication with the demultiplexer 43 and, upon receipt of the output signal from the receiving decoder 42, causes an actuating signal to be formed in the demultiplexer 43 for the particular output represented by the address provided by counter 41. A plurality of monoflops 46*a* through 46*n* are connected behind the demultiplexer 43 to the respective outputs of the demultiplexer and are in commumication with the control module 5 or 1*a* depending on the location of the respective receiver.

Figure 5:
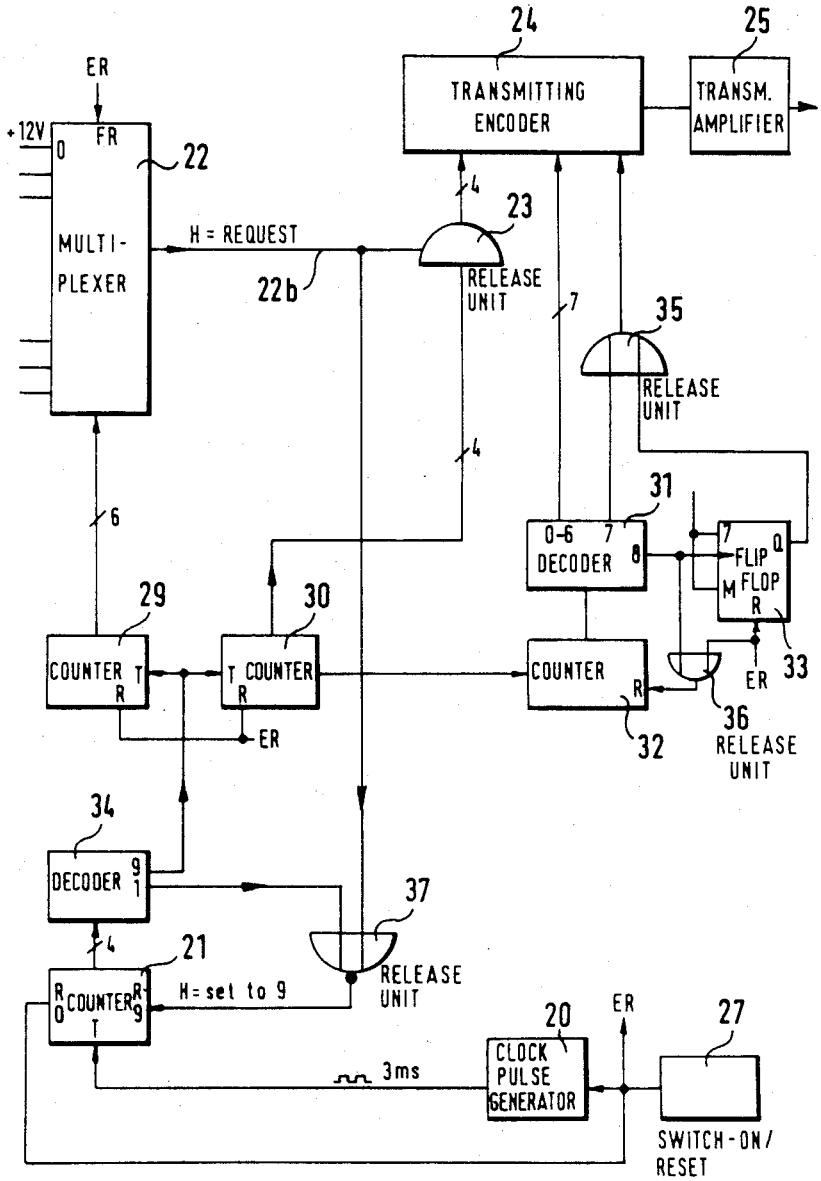
FIG. 5 is a block circuit diagram showing a modified embodiment of the transmitter according to FIG. 3.

FIG. 5 shows a transmitter according to FIG. 3 equipped with further electrical elements by means of which the interrogation speed of the transmitter may be increased in that coded address data is transmitted only if a signal is present at the respective data input being interrogated and in that the next address for a data input to the multiplexer is formed in the transmitting encoder as soon as it is determined that the presently selected data input has no signal.

As shown in FIG. 5, wherein the same elements as found in FIG, 3 are given the same reference numerals, the output of the clock pulse generator 20 is connected to the count or toggle input of the counter 21 whose four parallel output leads are connected to a decoder 34 which provides outputs when a count of "9" or a count of "1" is detected. The "1" output of decoder 34 is connected to one input of a release unit, i.e., a NOR gate, 37 whose other input is connected to the output 22*b* of the multiplexer 22, and whose output is connected to a reset input of counter 21 which causes the counter 21 to be reset to a count of "9". The "9" output of decoder 34 is connected to the count input of each of a pair of counters 29 and 30 with the parallel output leads (six as indicated) of counter 29 being connected to the multiplexer 22 to provide addresses for same, and with the output leads of the counter 30 being connected via the release or gate circuit 23 to the transmitting encoder 24.

The counter 30 has a further output which is connected to the input of a counter 32 whose output is connected to the input of a decoder 31 having outputs "0–6" connected to the transmitting encoder 24, output "7" connected to one input of an OR-gate 35 and an output "8" connected to the input of a flip-flop 33 and via an OR-gate 36 to the resent (R) input of counter 32. The "Q" output of flip-flop 33 is connected to the other input of OR-gate 35 whose output is connected to the transmitting encoder 24. In order to turn the clock pulse generator 20 on and off and to reset the various counters to a zero count at the desired time, a switch-on/reset circuit 27 is provided which produces a reset signal ER which is fed directly to the control input of clock pulse generator 20 and to the reset inputs of each of the counters 21, 29, 30 and of the flip-flop 33, and is fed to the reset input of counter 32 via the OR-gate 36.

A transmitting encoder that could be used in block 24 of FIG. 5, is known, for example, from the SIEMENS brochure entitled "INFRAFERN"—das Baugruppensystem für Infrarot-Fernbedienung" [INFRAFERN—The Module System For Infrared Remote Control] B/2339 (9.80) under the nomenclature SAB 3210.

Elements 22, 29, 30, 34, 21, 37, 20 and 27 of FIG. 5 serve to interrogate the inputs and to make a decision whether to effect data transmission or not. In the case of data transmission, elements 24, 25, 23, 35, 31, 32, 36 and 33 serve to form the associated address. The formation of these addresses is provided, for example, by the encoder module SAB 3210 from the SIEMENS brochure "INFRAFERN—das Baugruppensystem für Infrarot-Fernbedienung" [INFRAFERN—The Module System for Infrared Remote Control].

Figure 6:
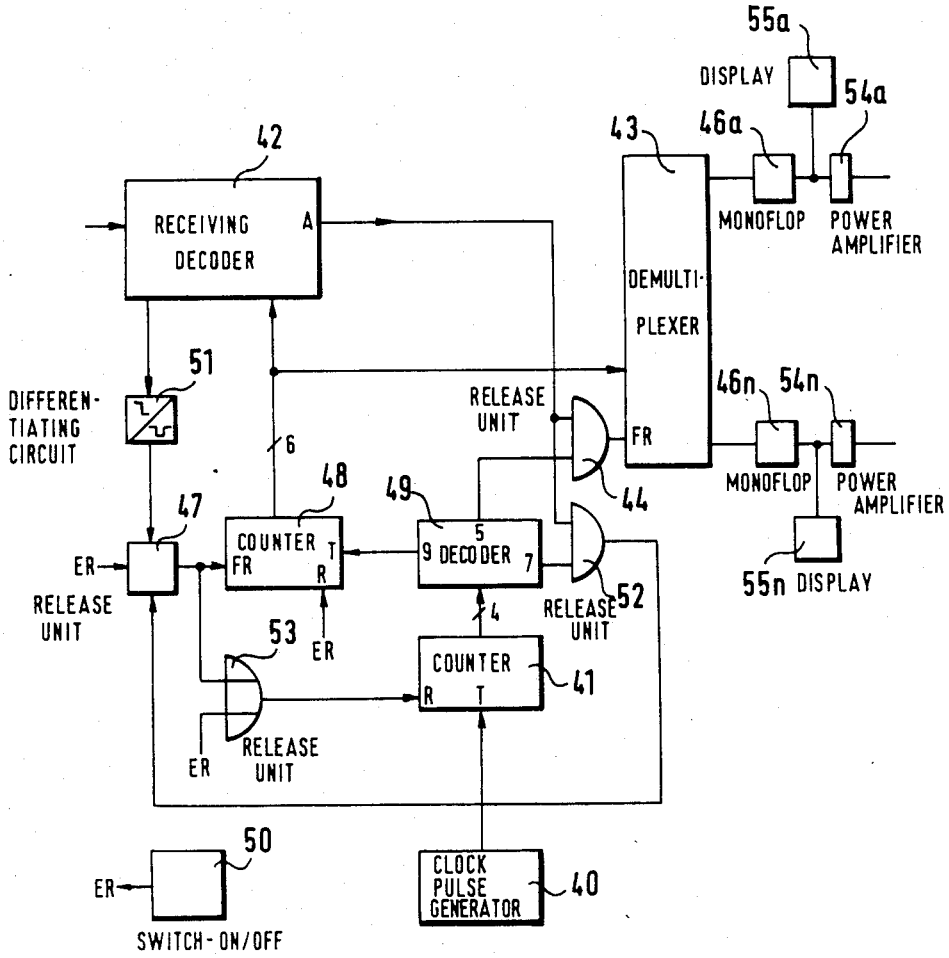
FIG. 6 is a block circuit diagram showing a modified embodiment of the receiver of FIG. 4.

FIG. 6 shows a receiver according to FIG. 4 equipped with further electrical elements for receiving and decoding the signal provided by the transmitter of FIG. 5. The interrogation arrangement, as shown in FIG. 6, for the receiving decoder 42 includes, in addition to the clock pulse generator 40, the counter 41 and the release unit or device 47 (which as shown is an OR-gate) of FIG. 3, a counter 48, a decoder 49, a switch-on-reset circuit 50, a differentiating circuit 51, and additional release circuits 52 and 53.

As shown in FIG. 6, the parallel outputs (four as indicated) of the counter 41, which receives and counts the clock pulses from clock pulse generator 40, are connected to a decoder 49 having three outputs, i.e., a "5" output connected to one input of the release unit 44 (which as shown is an AND-gate), a "7" output connected to one input of the release unit, i.e., AND-gate, 52, and a "9" output connected to the count input of the counter 48 whose outputs provide the addresses for the receiving decoder 42 and the demultiplexer 43. The other input of each of the AND-gates 44 and 52 is connected to the signal output A of receiving decoder 42 at which a signal appears if coincidence is detected between a received address and the address provided by counter 48. The output of AND-gate 44 is connected to the demultiplexer 43, and provides the release signal for same at the appropriate time, while the output of AND-gate 52 is connected to one input of the release unit or device 47 having a further input connected to the output of the differentiating circuit 51 which provides an output whenever the receiving decoder 42 is receiving coded data from the transmitter. The output of the release device 47 is fed to the reset input of counter 41 via the OR-gate 53 and to the "FR" input of counter 48 so as to cause counters 41 and 48 to form new addresses upon receipt of a data signal by the receiving decoder 42. The output signal ER of the switch-on/reset circuit 50 is connected to a further input of the release device 47, the reset input of counter 48 and to the reset input of counter 41 via the OR-gate 53. Finally, each of the n outputs of demultiplexer 43 is connected to a respective monoflop **46*a*–46*n* with each of the monoflops 46*a* to 46*n* having its output connected to an associated power amplifier 54*a*–54*n* by means of which relays (not shown) displays and the like are operated. Each monoflop 46*a*–46*n* has its output connected to it a respective display device 55*a*–55*n*** which indicates the state of the associated monoflop.

The release device 47 may be, for example, a known flip-flop element, i.e. an electrical memory element.

The elements 42, 51, 47, 48, 53, 49, 41, 52 and 40 serve to decode the received signals and to form an associated address which is forwarded to elements 43, 46, 55 and 54 and serves to actuate these elements.

It will be understood that the above description of the present invention is susceptible to various modifications, changes and adaptations, and the same are intended to be comprehended within the meaning and range of equivalents of the appended claims.

What is claimed is:

1. In combination with a power driven textile fiber bale opener machine including a fixed control station and a mobile station and having a movable delivery member mounted on an arm which can be rotated into different operating positions with said delivery member and said arm being disposed at said mobile station, an apparatus for transmitting signals between said fixed station and said mobile station comprising:

a transmitter and a receiver disposed at said fixed station; a plurality of transmitters and a plurality of receivers disposed at said mobile station; said transmitter at said fixed station being associated with said receivers at said mobile station and said receiver at said fixed station being associated with said transmitters at said mobile station, with said receivers and transmitters at said mobile station being disposed so that said receiver and said transmitter of said fixed station face, and are in wireless communication with, a different transmitter and receiver respectively of said mobile station at each of said different operating positions;

each of said transmitters including: a clock pulse generator; counter means for counting the clock pulses from said pulse generator and for providing a plurality of parallel bits, which form addreses, at its output; multiplexer means, having a plurality of data inputs and responsive to said bits provided by said counter means, for selecting a certain of said data inputs in dependence on the particular address so as to establish an electrical connection between the selected said data input and a release input of a gate circuit whose input is connected to the output of said counting means; and a transmitting encoder means, having its input connected to the output of said gate circuit, for providing coded data for transmission to the associated receiver, whereby said electrical connection causes said gate circuit to release the address being provided by said counter means to said transmitting encoder means if a signal is present at the selected data input; and each of said receivers including: a further clock pulse generator; further counter means for counting the clock pulses from said further clock pulse generator and for providing a plurality of bits, which form addresses, at its output; receiving decoder means for comparing received transmitted data, corresponding to the address of a selected input of the said multiplexer means of the associated transmitter, with the address output data provided by said further counter means and for providing an output signal when said data coincide; signal release means, connected to the output of said receiving decoder means, for providing an output signal only upon receipt of said output signal from said receiving decoder means; and a demultiplexer means, responsive to the address data from said further counter means and to said output signal from said signal release means, for providing an output signal on the one of its said data outputs corresponding to the address indicated by the concurrent address data from said further counter means.

2. Apparatus as defined in claim 1 wherein each said transmitter further includes a transmitting amplifier connected to the output of said transmitting encoder means.

3. Apparatus as defined in claim 2 wherein a light transmitting diode is connected to the output of said amplifier.

4. Apparatus as defined in claim 3 wherein said diode is an infrared transmitting diode.

5. Apparatus as defined in claim 3 wherein each said receiver includes a light receiving diode connected ahead of the input of said receiving decoder means.

6. Apparatus as defined in claim 1 wherein a monoflop is connected to at least one of said data outputs of said demultiplexer means.

7. Apparatus as defined in claim 6 wherein the output of each said monoflop is connected via a power amplifier to a relay or display device for operating same.

8. Apparatus as defined in claim 6 wherein a display device is connected to the output of said monoflop to indicate the switching state of the monoflop.

9. Apparatus as defined in claim 1 wherein each said transmitter and receiver includes a switch-on/reset circuit for resetting said counter and further counter means, respectively.

10. Apparatus for transmitting signals between a fixed station and a mobile station in a power driven textile machine, comprising in combination: a transmitter and a receiver disposed at said fixed station; a transmitter and a receiver disposed at said mobile station; said transmitter at said fixed station being associated with said receiver at said mobile station and said receiver at said fixed station being associated with said transmitter at said mobile station;

each of said transmitters including: a clock pulse generator; counter means for counting the clock pulses from said pulse generator and for providing a plurality of parallel bits, which form addresses, at its output; multiplexer means, having a plurality of data inputs and responsive to said bits provided by said counter means, for selecting a certain of said data inputs in dependence on the particular address so as to establish an electrical connection between the selected said data input and a release input of a gate circuit whose input is connected to the output of said counting means; and a transmitting encoder means, having its input connected to the output of said gate circuit, for providing coded data for transmission to the associated receiver, whereby said electrical connection causes said gate circuit to release the address being provided by said counter means to said transmitting encoder means if a signal is present at the selected data input; and each of said receivers including: a further clock pulse generator; further counter means for counting the clock pulses from said further clock pulse generator and for providing a plurality of bits, which form addresses, at its output; receiving decoder means for comparing received transmitted data, corresponding to the address of a selected input of the said multiplexer means of the associated transmitter, with the address output data provided by said further counter means and for providing an output signal when said data coincide; signal release means, connected to the output of said receiving decoder means, for providing an output signal only upon receipt of said output signal from said receiving decoder means; and a demultiplexer means, responsive to the address data from said further counter means and to said output signal from said signal release means, for providing an output signal on the one of its said data outputs corresponding to the address indicated by the concurrent address data from said further counter means; and said counting means of said transmitter includes: a first counter having a count input connected to the output of said clock pulse generator of said transmitter, a reset input for resetting said first counter to the value "9", and an output; a first decoder having an input connected to the output of said first counter, a first output for the value "1" and a second output for the value "9"; a NOR-gate having its output connected to said reset input of said first counter, a first input connected to said first output of said first decoder and a second input connected to the output of said multiplexer means; second and third counters each having their count inputs connected to said second output of said first decoder and with the output of said second counter being connected to said multiplexer means to provide said addresses, and with one output of said third counter being connected to said gate circuit; a fourth counter having its input connected to a further output of said third counter and its output connected to the input of a second decoder; said second decoder having a first output connected to said transmitting encoder means, a second output connected to one input of an OR-gate, and a third output connected to a reset input of said fourth counter and to the input of a flip-flop whose output is connected to a second input of said OR-gate; and said OR-gate has its output connected to an input of said transmitting encoder means.

11. Apparatus as defined in claim 10 wherein said further counter means includes: a fifth counter having its count input connected to the output of said further clock pulse generator and its output connected to the input of a third decoder; a sixth counter having its count input connected to a first output of said third decoder and its output connected to said receiving decoder means and to said demultiplexer means to provide said address data; a first AND-gate, constituting said signal release means, having a first input connected to said output of said receiving decoder means and a second input connected to a second output of said third decoder; a second AND-gate having a first input connected to said output of said receiving decoder means and a second input connected to a third output of said third decoder; differentiating circuit means, having an input connected to said receiving decoder means, for providing an output pulse when said receiving decoder means is receiving transmitted data; and release circuit means, having respective inputs connected to the output of said differentiating circuit means and to the output of said second AND-gate, and an output connected to a further input of said sixth counter and to a reset input of said fifth counter, for controlling the count state of said fifth and sixth counters.

12. Apparatus as defined in claim 10 wherein said transmitters and their associated said receivers are in wireless communication with one another.

13. Apparatus as defined in claim 12 wherein: said transmitter at said fixed station is disposed opposite said receiver at said mobile station and said receiver at said fixed station is disposed opposite said transmitter at said mobile station.

14. Apparatus as defined in claim 10 wherein said transmitters and their associated receivers are in communication with each other via a transmission line.

15. Apparatus as defined in claim 1 or 10 wherein each said transmitter includes means for causing the transmitter to send data to the associated receiver only if a signal is present at the respective data input of said multiplexer means.

16. Apparatus as defined in claim 1 or 10 wherein each said transmitter includes circuit means for causing the next address to be formed in said transmitter as soon as a determination has been made that the selected data input has no signal.

17. Apparatus as defined in claim 1 or 10 wherein each said receiver includes circuit means for emitting a signal when said receiving decoder means is receiving address data from the associated said transmitter and, in response to said signal, for causing said further counter means to begin to form said addresses which are fed to said receiving decoder means for comparison with received transmitted address data.

* * * * *